US005409417A

United States Patent [19]

Bando

[11] Patent Number: 5,409,417

[45] Date of Patent: Apr. 25, 1995

[54] NUMERICALLY CONTROLLED GRINDING MACHINE FOR PLATE GLASS

[75] Inventor: Shigeru Bando, Tokushima, Japan

[73] Assignee: Bando Kiko Co., Ltd., Tokushima, Japan

[21] Appl. No.: 195,839

[22] PCT Filed: Jul. 8, 1991

[86] PCT No.: PCT/JP91/00909

§ 371 Date: Feb. 4, 1992

§ 102(e) Date: Feb. 4, 1992

[87] PCT Pub. No.: WO92/00831

PCT Pub. Date: Jan. 23, 1992

Related U.S. Application Data

[63] Continuation of Ser. No. 829,040, Feb. 4, 1992, abandoned.

[30] Foreign Application Priority Data

Jul. 9, 1990 [JP] Japan ..... 2-180775

[51] Int. Cl.[6] ..... B24B 9/10

[52] U.S. Cl. ..... 451/9; 451/5; 451/412; 451/44; 451/211; 451/242

[58] Field of Search ..... 51/165.71, 165.75, 165.76, 51/165.77, 165.8, 240 GB, 283 E, 90, 72 R, 88, 89, 103 R

[56] References Cited

U.S. PATENT DOCUMENTS

| | | | |
|---|---|---|---|
| 3,942,287 | 3/1976 | Tokunaga | 51/43 |
| 4,587,764 | 5/1986 | Leone et al. | 51/283 E |
| 4,685,180 | 8/1987 | Kitaya et al. | 51/5 C |
| 4,984,351 | 1/1991 | Matsuyama et al. | 51/165.77 |

FOREIGN PATENT DOCUMENTS

| | | |
|---|---|---|
| 58-56126 | 11/1983 | Japan . |
| 59-37040 | 2/1984 | Japan . |
| 62-246463 | 3/1987 | Japan . |

*Primary Examiner*—Bruce M. Kisliuk
*Assistant Examiner*—Eileen P. Morgan
*Attorney, Agent, or Firm*—Nixon & Vanderhye

[57] ABSTRACT

A numerically controlled grinding machine 60 for plate glass, comprising a table 3 for supporting the glass plate 5; a motor 35 connected to a grooved grinding wheel 38 that grinds by rotation thereof the periphery edge of the plate glass 5 supported by the table 3 to rotate the grooved grinding wheel; motors 11 and 53 for moving the grooved grinding wheel 38 relative to the plate glass in a direction X parallel to the surface of the plate glass as well as in a direction Y parallel to the surface of the plate glass and perpendicular to the first direction; a motor 40 for moving the grooved grinding wheel relative to the plate glass in a direction Z perpendicular to the surface of the plate glass 5; and a numerical control device connected to the motors 11, 53 and 40.

3 Claims, 5 Drawing Sheets

NUMERICALLY CONTROLLED GRINDING MACHINE FOR PLATE GLASS

This is a continuation of application Ser. No. 07/829,040, filed Feb. 4, 1992, now abandoned.

FIELD OF THE ART

The present invention relates to numerically controlled grinding machine for plate glass, and particularly for grinding the periphery edges of plate glass.

BACKGROUND ART

In a conventional grinding machine for plate glass, when the periphery edge of plate glass is to be chamfered or ground round, a grinding wheel for chamfering is prepared and used for chamfering purposes, or a grinding wheel for forming a round edge is prepared and used for rounding purposes.

When a plate glass like a car pane is ground round in a part of the periphery edge thereof, and is chamfered in the other part of the periphery edge thereof, for example, a specified part of the periphery edge is firstly ground by a grinding wheel for forming a round edge, and then the remaining part of the periphery edge is ground by a chamfering wheel replacing the grinding one. However, such a means is very inefficient in working because it will take time to replace the grinding wheel and the grinding program must be run twice.

In view of the above, it is an object of the present invention to provide a numerically controlled grinding machine for plate glass which is capable of forming a round edge and a chamfered edge on required parts of plate glass by running the grinding program once without replacing the wheel.

DISCLOSURE OF THE INVENTION

According to the present invention, the above object is achieved by a numerically controlled grinding machine for plate glass, comprising a table for supporting the glass plate, a rotating drive device connected to a grooved grinding wheel which grinds by rotation thereof the periphery edge of the plate glass supported by the table to rotate the grooved grinding wheel, a first moving device for relatively moving the grooved grinding wheel relative to the plate glass in a first direction parallel to the surface of the plate glass as well as in a second direction parallel to the surface of the plate glass and perpendicular to the first direction, a second moving device for relatively moving the grooved grinding wheel relative to the plate glass in a third direction perpendicular to the surface of the plate glass, and a numerical control device connected to the first and second moving devices for numerically controlling the movements of the first and second moving devices.

According to the present invention, the above object is also achieved by the numerically controlled grinding machine for plate glass which includes a orbiting device connected to the grooved grinding wheel to orbit the grooved grinding wheel in the surface of the plate glass, the numerical control device being connected to the orbiting device in order to control the orbiting operation of the orbiting device numerically.

In addition to the first moving device, the numerically controlled grinding machine for plate glass according to the present Invention include the second moving device for relatively moving the grooved grinding wheel relative to the plate glass in the third direction perpendicular to the surface of the plate glass. This second moving device as well as the first moving device are connected to the numerical control device to be controlled numerically. Thus, in grinding the periphery edge of the plate glass, the periphery edge of the plate glass is rendered round by causing the second moving device to move the grooved grinding wheel in the third direction relative to the plate glass to touch the groove of the grinding wheel equally to the periphery edge of the plate glass. The periphery edge of the plate glass is chamfered by causing the second moving device to move the grooved grinding wheel to the plate glass in the third direction relative to touch the groove of the grinding wheel unequally to the periphery edge of the plate glass. Therefore, both the round and chamfered edges are formed on the required part of the periphery edge of the plate glass without replacing the grooved grinding wheel by running the grinding program once. This greatly reduces the operation hours as well as highly simplifies the grinding work.

The numerically controlled grinding machine for plate glass according to the present invention which includes the orbiting device for orbiting tile grooved grinding wheel in the surface of the plate glass is capable of disposing the grinding point on the central axis of orbiting as well as simplifying the program, and also capable of accurately grinding the periphery edge of plate glass which has many curves like disk plate glass or oval plate glass.

The present invention will be described hereinafter in more detail with respect to embodiments thereof shown in the drawings. By this description, the above invention and its advantages as well as the other invention and its advantages will be clarified. It is to be noted that the present invention is not at all limited to these embodiments.

BEST MODE FOR CARRYING OUT THE INVENTION

Figure 1:
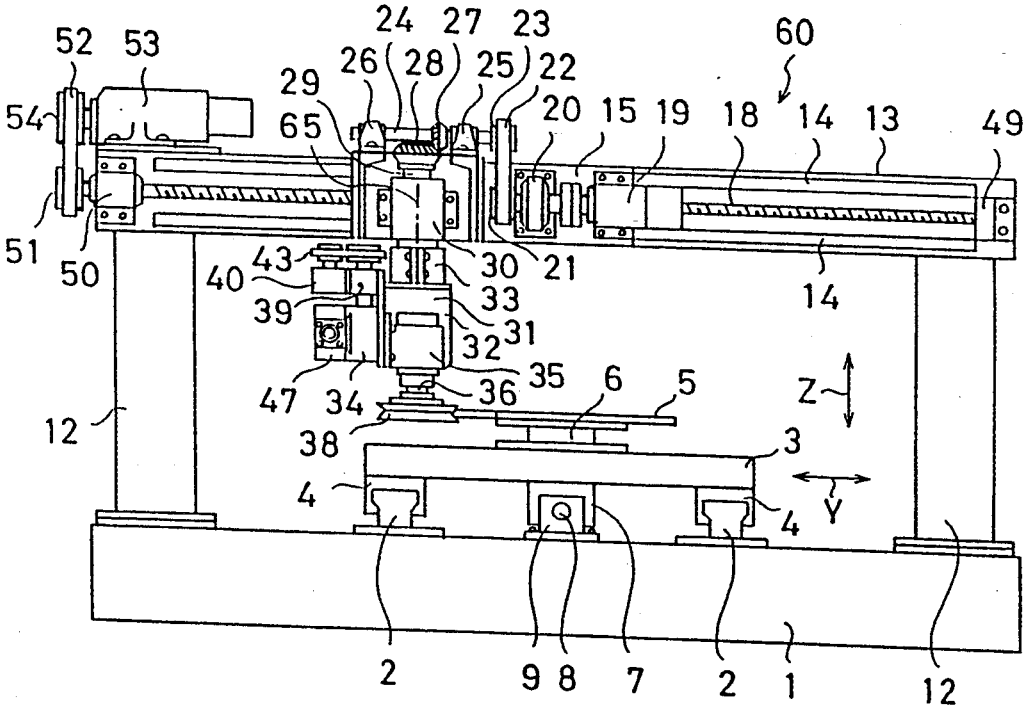
FIG. 1 is a front view of a preferred embodiment of the present invention.
Figure 2:
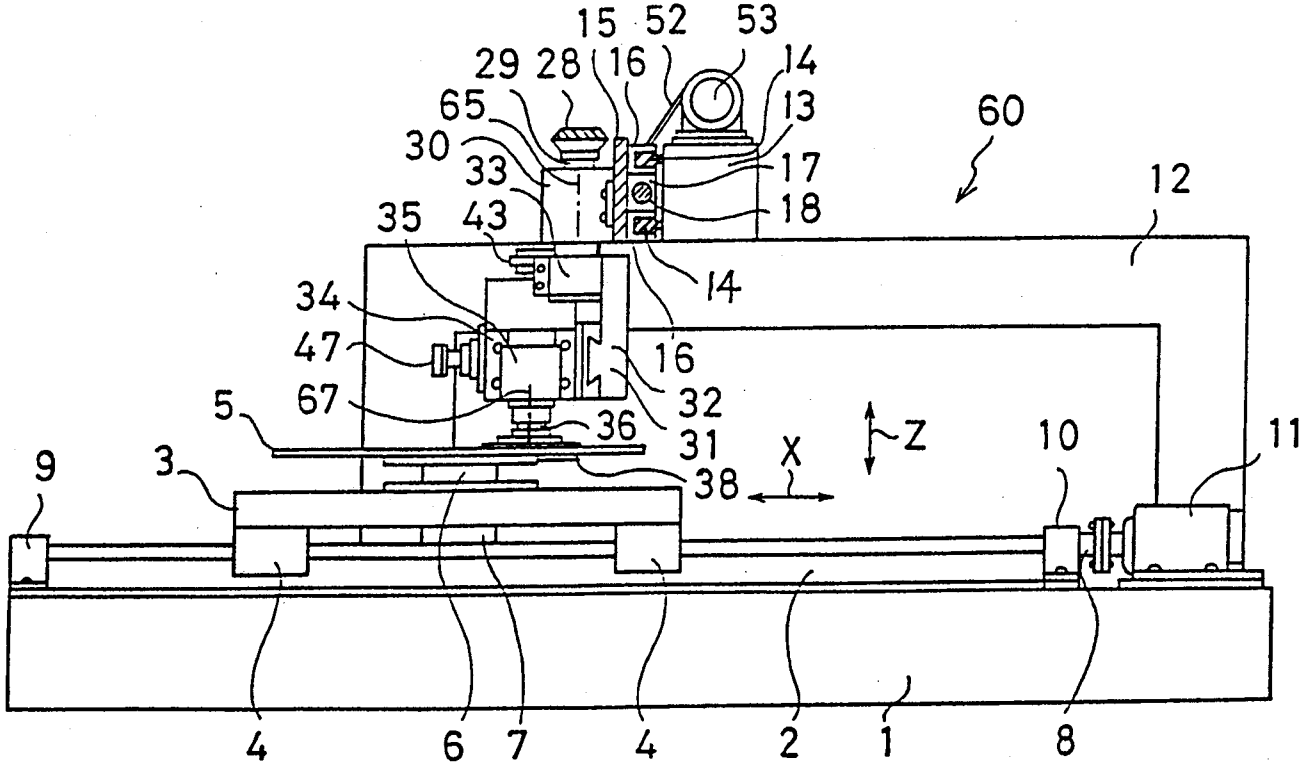
FIG. 2 is a side view of the embodiment shown in FIG. 1.
Figure 3:
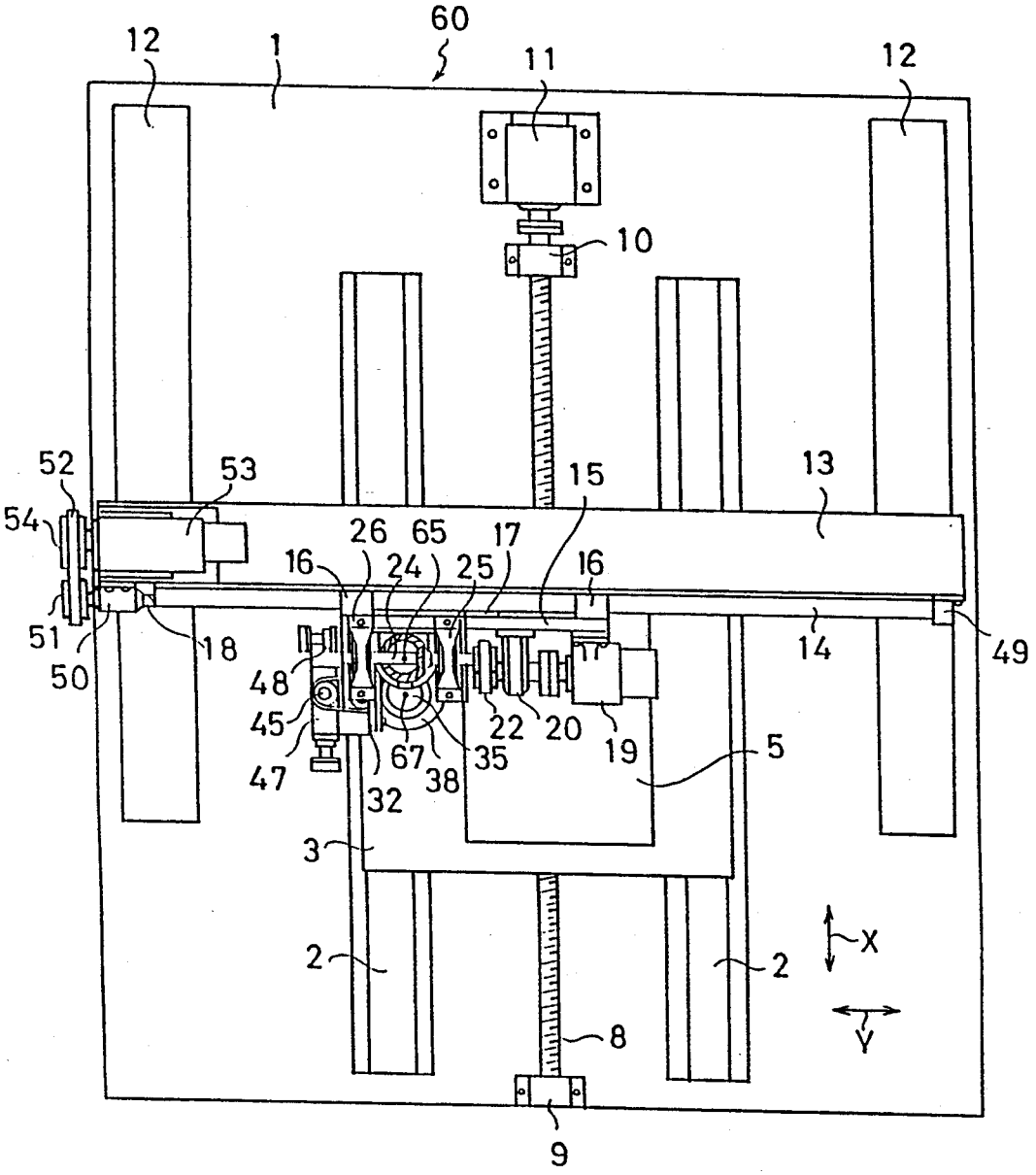
FIG. 3 is a plan view of the embodiment shown in FIG. 1.
Figure 4:
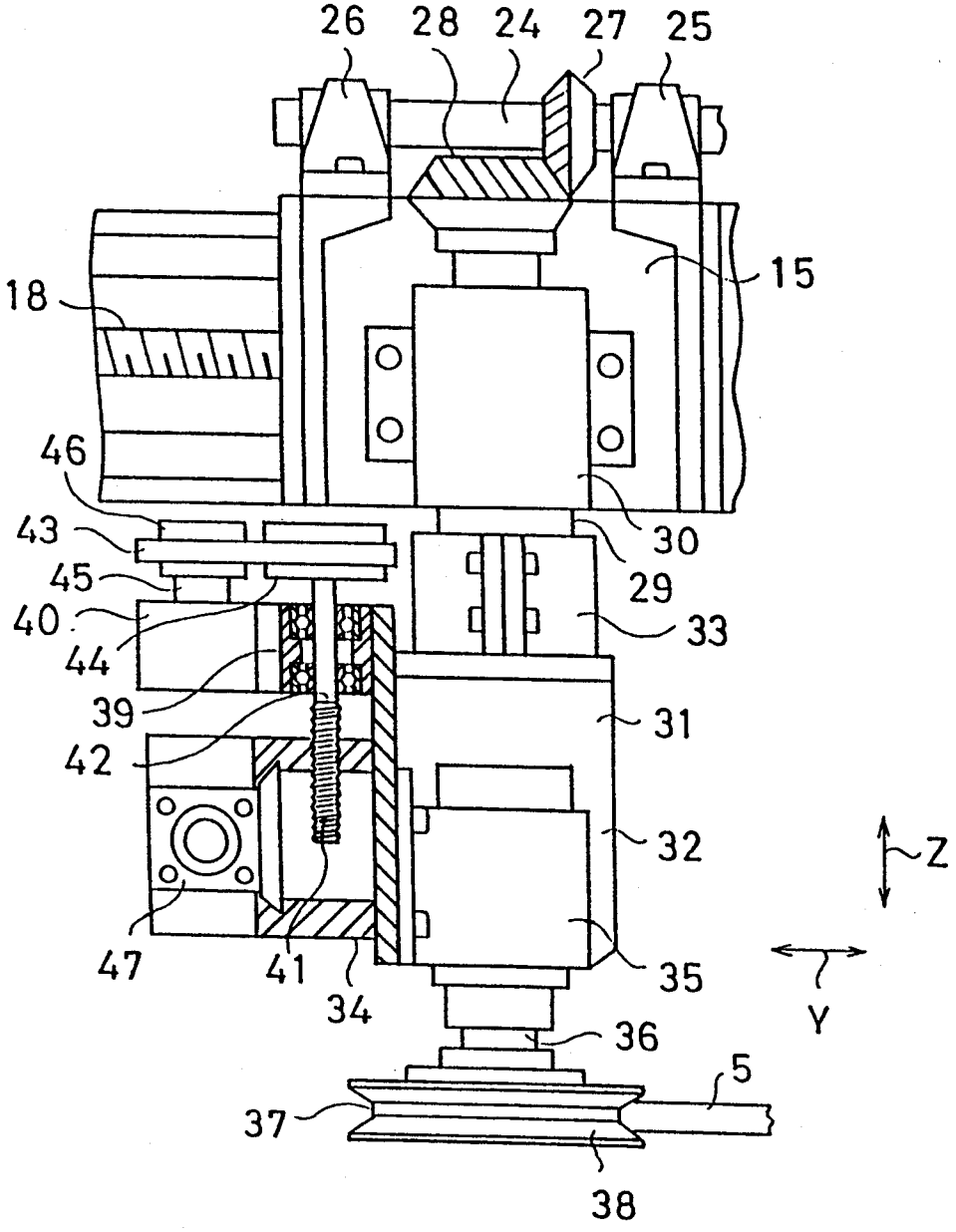
FIG. 4 is a partially enlarged view of the embodiment shown in FIG. 1.

Referring to FIGS. 1 to 4, a pair of parallel rails 2 is mounted on a base 1. A slider 4 attached fixedly to a table 3 is fitted to the rails 2 so as to be slidable in the direction X, i.e., in a first direction parallel to the surface of plate glass 5. A suction device 6 is mounted on the table 3 to fix the plate glass 5 by vacuum suction. The table 3 is secured at a lower surface thereof with a nut 7 into which a threaded bar 8 is screwed. The threaded bar 8 is rotatably supported at both ends thereof by bearings 9 and 10. The threaded bar 8 is connected at one end thereof to a rotating output shaft of a servo motor 11 which is fixed to the base 1. When the threaded bar 8 is rotated by the rotation of the rotating output shaft of the motor 11, the nut 7 screwed over the threaded bar 8 is moved in the direction X. As a result, the table 3 and hence the plate glass 5 are also moved in the direction X.

A pair of support frames 12 attached to the base 1 is bridged with a cross support frame which is attached at the side thereof with a pair of parallel rails 14. A slider 16 fixed to a moving base 15 is fitted to the rails 14 so as to be slidable in a direction Y, i.e., a second direction parallel to a surface of the plate glass 5 as well as perpendicular to the direction X. Attached to the moving base 15 is a nut 17 into which the threaded bar 18 is screwed.

A rotating output shaft of a servo motor 19 attached to the moving base 15 is connected to a pulley 21 through a bearing 20. A belt 22 extends around the pulley 21 as well a pulley 23. A rotating shaft 24 of the pulley 23 is supported rotatably by bearings 25 and 26 which are attached to the moving base 15. A gear 27 secured to the rotating shaft 24, is meshed with a gear 28, a rotating shaft 29 of which is supported rotatably by a bearing 30 attached to the moving base 15. A support 32 of a grinding head 31 is provided at an upper end thereof with a gripper 33 which grips a lower end of the rotating shaft 29 to connect the grinding head 31 with the shaft 29 in a hanging manner. A slider 34 is attached to the support 32 so as to be slidable in a direction Z, i.e., a third direction perpendicular to the surface of the plate glass 5. Attached to the slider 34 is a motor 35 a rotating output shaft 36 of which serves also as a spindle and is provided with a grooved grinding wheel 38 which has a groove 37. By the rotation of the rotating output shaft 36 of the motor 35 as a rotating drive device, a grinding wheel 38 is rotated around a center line 67 to grind the periphery edge of the plate glass 5. By the rotation of the rotating output shaft of the motor 19, the rotating shaft 29 is rotated around a center line 65 thereof through the pulley 21, belt 22, pulley 23, rotating shaft 24, gear 27 and gear 28. As a result, the support 32 and hence the motor 35 and the grinding wheel 38 are orbited around the center line 65. Therefore, the motor 19, gears 27, 28, griper 33 and support 32 compose a orbiting device for orbiting the grlndlng wheel 38 in the surface of the plate glass 5.

The support 32 are secured with a servo motor and a bearing 39 which rotatably supports a rotating shaft 42 with a threaded part 41 screwed into the slider 34. A pulley 44 around which a belt 43 extends is secured to one end of the rotating shaft 42. The belt 43 also extends around a pulley 46 which is attached to a rotating output shaft 45 of the motor 40. The rotation of the shaft 45 of the motor 40 makes the shaft 42 rotate through the pulley 46, belt 43 and pulley 44. As a result, the slider 34 into which the threaded part 41 is screwed, and hence the motor 35 as well as the grinding wheel 38 is moved in the direction Z. Consequently, the motor 40, pulleys 44, 46, belt 43, rotating shaft 42 and slider 34 compose a moving device for relatively moving the grinding wheel 38 relative to the glass plates in a third direction perpendicular to the surface of the glass plate 5.

It is to be noted that fine adjustment mechanisms 47 and 48 for moving the motor 35 finely in the directions X and Y are mounted on the support 32.

A threaded bar 18 is rotatably supported at both ends thereof by bearings 49 and 50, and is secured at one end thereof with a pulley 51. A belt 52 extending around the pulley 51 also extends around a pulley 54 attached to a rotating output shaft of a servo motor 53. By rotation of the rotating output shaft of the motor 53, the screwed bar 18 is rotated through the pulley 54, belt 52 and pulley 51. As a result, the nut 17 screwed over the threaded bar 18 is moved in the direction Y. Accordingly, the moving base 15 and hence the motor 35 and the grinding wheel 38 are moved in the direction Y.

Consequently, an X-direction moving device comprising the motor 11, threaded bar 8, nut 7 and table 3 as well as a Y-direction moving device comprising the motor 53, threaded bar 18, nut 17 and moving base 15 compose the moving device for relatively moving the grinding wheel 38 relative to the glass plate 5 in the first direction which is parallel to the surface of the plate glass 5 and in the second direction which is parallel to the surface of the plate glass 5 and perpendicular to the first direction.

The motor 11, 19, 35, 40 and 53 are connected to a numerical control device (not shown), so that the rotations of their rotating output shafts are controlled by the numerical control device.

Figure 5:
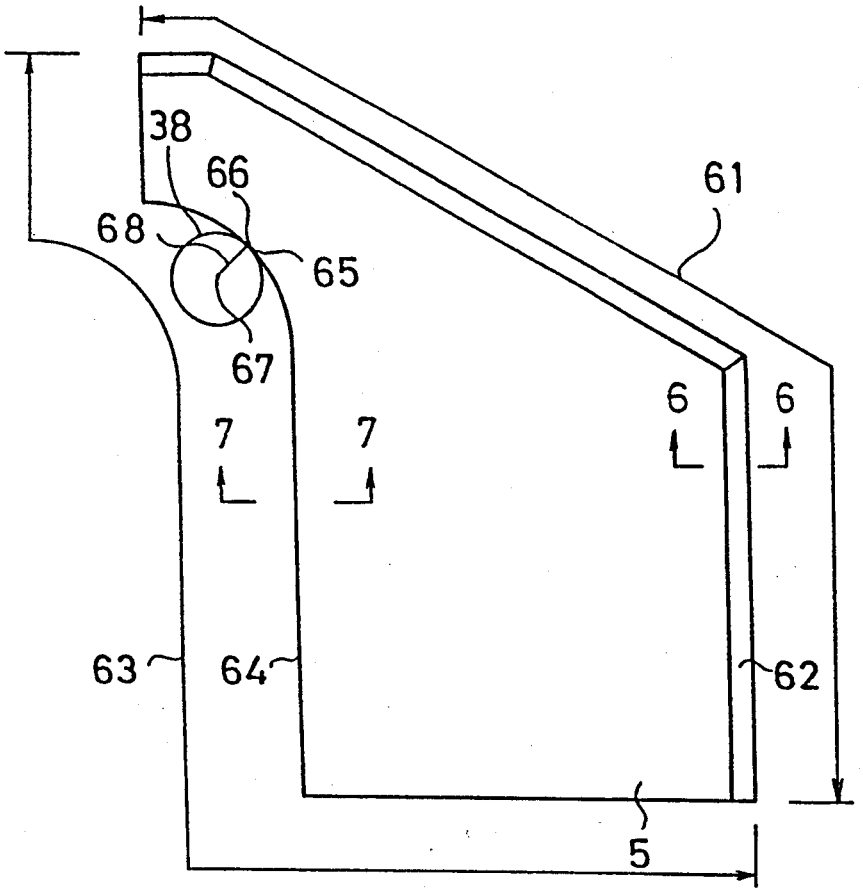
FIG. 5 is a plan view of an example of plate glass to be ground.
Figure 6:
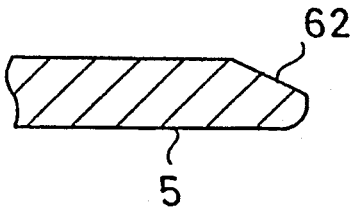
FIG. 6 is a sectional view taken along the line 6—6 shown in FIG. 5.
Figure 7:
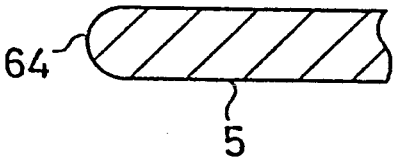
FIG. 7 is a sectional view taken along the line 7—7 shown in FIG. 5.

The following is a description of the case where the numerically controlled grinding machine for plate glass 60 thus constructed forms a chamfered edge (taper edge) 62 on the periphery part 61 of the plate glass 5 of the car window shown in FIG. 5, as shown in FIG. 6, and a round edge 64 on the periphery part 63, as shown in FIG. 7.

First, the numerical control program is made such that the periphery edge of the plate glass 5 to be ground is disposed on an extension of the center line 65. The plate glass 5 to be ground is fixed on the table 3 by the suction device 6. Now the fine adjustment mechanisms 47 and 48 are operated such that the grinding point (working point) 66 where the grinding wheel 38 is in contact with the plate glass 5 Is disposed on a periphery edge of the plate glass 5 to be ground, in other words, on an extension of the center line 65. Thereafter, operating the numerical control device causes the numerically controlled rotation of the rotating output shafts of the motors 11 and 53 to make the threaded bars 8 and 18 rotate. As a result, the table 3 is moved in the direction X and the moving base 15 is moved in the direction Y, whereby the center line 65, i.e. the grinding point 66, is moved sequentially along the periphery edge of the plate glass 5 to be ground and the grinding wheel 38 is rotated. As a result, the periphery edge of the plate glass is subjected to a grinding work. As a result of numerically controlling the motor 19 using the numerical control device during grinding, the numerically controlled rotation of the rotating output shaft of the motor 19 makes the rotating shaft 29 rotate through the belt 22, rotating shaft 24, and gears 27 and 28. Therefore, the support 32 is orbited around the center line 65 of the rotating shaft 29 such that the straight line 68 which connects the center line 67 of the grlndlng wheel 38 to the orbiting center 65 is to be a normal line at the grinding point 66 on the periphery edge of the plate glass 5.

Concerning the grinding of the periphery part 61, the motor 40 is numerically controlled by the numerical control device such that the grinding wheel 38 deviates towards the table 3. The rotation of the output shaft 45 of the motor 40 under numerical control device makes the rotating shaft 42 rotate through the pulley 46, belt 43, and pulley 44, and the slider 34 is moved in the direction Z. As a result, the motor 35 and the grinding wheel 38 are moved in the direction Z as well. When the grinding wheel 38 is moved towards the table 3 or in one direction concerning the direction Z, the periphery edge of the plate glass 5 is strongly pressed against one slope of the groove 37 in the grinding wheel 38 and ground. As a result, a chamfered edge 62 as shown in FIG. 6 is formed on the periphery edge of the plate glass 5. Concerning the grlndlng of the periphery part 63 continued to the periphery part 61, the motor 40 is controlled by the numerical control device such that the periphery edge of the plate glass 5 is positioned in the groove 37 without deviation. As a result, the plate glass 5 formed on the periphery part 63 with the round edge 64 as shown in FIG. 7 is produced.

While in the embodiment as described above the positioning concerning the direction X for the grinding point 66 is effected by moving the table 3, the table 3 may be fixed instead and the supporting frame 13 may be moved in the direction X, or the table 3 itself may be moved both in the directions X and Y.

In addition, while in the embodiment as described above the positioning concerning the direction Z for the grinding point 66 is effected by moving the slider 34, the table 3, plate glass 5, etc., may be moved instead in the direction Z.

While control for the rotation of the rotating output shaft 36 of the motor 35 may be achieved by the numerical control device, the present invention is not limited to this and the shaft 36 may be rotated at constant rotation speed at all times.

As described above, according to the present invention, plural kinds of edge shapes are formed on the periphery edge without replacing the grooved grinding wheel, and plural different kinds of edge shapes are formed on required portions on the periphery edge of a single sheet of plate glass by running the grinding program once.

I claim:

1. A method for grinding a peripheral edge of a plate glass supported on table means, comprising the steps of:

rotating a grinding wheel about an axis, said grinding wheel having a groove including two opposite sloped surfaces on a periphery thereof;

moving said wheel and the plate glass relative to one another in a first direction parallel to a top planar surface of the plate glass, and in a second direction parallel to the top planar surface of the plate glass and perpendicular to the first direction to come into contact with the groove of the grinding wheel and the peripheral edge of the plate glass to each other and thereby to grind the peripheral edge of the plate glass by means of the groove of the grinding wheel rotated; and moving said grinding wheel relative to the plate glass in a third direction perpendicular to the planar top surface of the plate glass such that said wheel is positioned at a first position in the third direction relative to the plate glass in a first predetermined region of the peripheral edge of the late glass to grind the peripheral edge portion of the plate glass into a first edge shape, and said wheel is positioned at a second position in the third direction relative to the plate glass in a second predetermined region of the peripheral edge of the plate glass to grind the peripheral edge portion of the plate glass into a second edge shape different from the first edge-shape, pressing the two opposite sloped surfaces of the wheel against the peripheral edge of the plate glass with a force substantially equal to each other when said wheel is positioned at the first position, pressing one of the sloped surfaces of the wheel against the peripheral edge of the plate glass with a force greater than a force with which the other sloped surface of the wheel presses the peripheral edge of the plate glass, when said wheel is positioned at the second position.

2. A method for grinding a plate glass as claimed in claim 1, further comprising a step of orbiting said grinding wheel in a surface parallel to the top surface of the plate glass.

3. A method for grinding a plate glass as claimed in claim 2, wherein said orbiting step comprises a step of orbiting said grinding wheel around an axis extending and passing through the peripheral edge of the plate glass to be ground such that a straight line connecting the orbiting axis of the wheel to the peripheral edge of the plate glass to be ground is a normal line to the peripheral edge of the plate glass to be ground.

* * * * *